US005259627A

United States Patent [19]

Alsip

[11] Patent Number: 5,259,627

[45] Date of Patent: Nov. 9, 1993

[54] MEMORY GAME

[76] Inventor: Bruce F. Alsip, P.O. Box 10237, Bainbridge Island, Wash. 98110

[21] Appl. No.: 27,271

[22] Filed: Mar. 5, 1993

[51] Int. Cl.[5] ..... A63F 9/00

[52] U.S. Cl. ..... 273/459

[58] Field of Search ..... 273/459, 440

[56] References Cited

U.S. PATENT DOCUMENTS 2,324,691 7/1943 Gardner ..... 273/459
3,424,455 1/1969 Dunson ..... 273/459
3,918,717 11/1975 Charves ..... 273/459 X
4,036,493 7/1977 Breslow ..... 273/459
4,640,510 2/1987 Braddock et al. ..... 273/459

*Primary Examiner*—Paul E. Shapiro
*Attorney, Agent, or Firm*—Jensen & Puntigam

[57] ABSTRACT

A game wherein each player has a set of distinguishable playing pieces which are placed seriatim into a chosen one of three apparently identical receptacles. Each of the receptacles are marked to accompany one set of pieces and are periodically shuffled to challenge the players to place their piece in the correct receptacle.

2 Claims, 2 Drawing Sheets

MEMORY GAME

DESCRIPTION

1. Technical Field

This invention relates to a game and to an apparatus for playing the game and, more particularly, to a game which challenges the memory and manual dexterity and an apparatus which permits the selective placement of distinguishable game pieces within one of three or more receptacles while keeping the previously played pieces from view. The receptacles are then shuffled, making it more difficult to keep track of the previously played pieces.

2. Background Art

Historically, games have been used to entertain and challenge. One of the well known games has traditionally been used as a form of gambling, wherein a playing piece is placed beneath one of three identical cups and then the cups are manipulated as to position, leaving the observer the challenge of determining which of the identical cups contains the playing piece following the rapid and random shuffling of the cups. This game has been known by the term "the shell game."

The present game is a variation of the shell game but is used not as a gambling game but as a game of challenge between two or more players. Instead of using one playing piece, a plurality of playing pieces are utilized. Each of the players has a set of similarly identified playing pieces and these pieces are systematically placed seriatim into a plurality of receiving means, normally three, which include identical cover pieces having a playing piece receiving opening. The cover pieces are placed over a base member which will have means to identify it in accordance with the playing piece identifying means. When the game starts, the players will know the location of the bottom playing piece receiving means and will identify the one that corresponds with their set of playing pieces. The covers are then placed over the receiving means and the cover and captured receiving means will be rapidly manipulated, attempting to confuse the players as to the location of the receiving means which are marked similarly to their set of playing pieces.

The players in turn attempt to place one of their playing pieces within the receptacle bearing their identification and the receptacles are again rapidly and irregularly moved to again attempt to confuse the observer. The previously played playing pieces and the markings on the receiving device remain hidden from view and the hereinabove-described sequence of events is repeated until all of the playing pieces have been placed within the receiving means. Scoring is based upon the number of playing pieces which have been correctly placed within the similarly identified receiving means. The game may be varied depending upon the skill and sophistication of the players.

DISCLOSURE OF THE INVENTION

The present invention is directed toward an apparatus designed for playing the game as hereinabove-described and comprises a piece receiving element generally cylindrical in cross-section and having an upwardly open trough about the rim and an upwardly extending, substantially conical centerpiece used in conjunction with a cover element which is designed to overlie the playing piece receiving element and includes a central bore such that playing pieces dropped through the bore strike the conical member and move into the trough, where they cannot be seen.

It is an object of the present invention to provide a game apparatus which permits the easy placement of playing pieces, is able to contain a plurality of the playing pieces, and further retains the playing pieces in a nonvisible location.

It is another object of the present invention to provide a game wherein a plurality of identical playing apparatuses are utilized to challenge the player's memory and hand/eye coordination as to the location of an identified hidden playing piece receiving means as well as identifying the location of the recipient of previous playing pieces after the plurality of apparatuses have been shuffled.

BEST MODE FOR CARRYING OUT THE INVENTION

Figure 1:
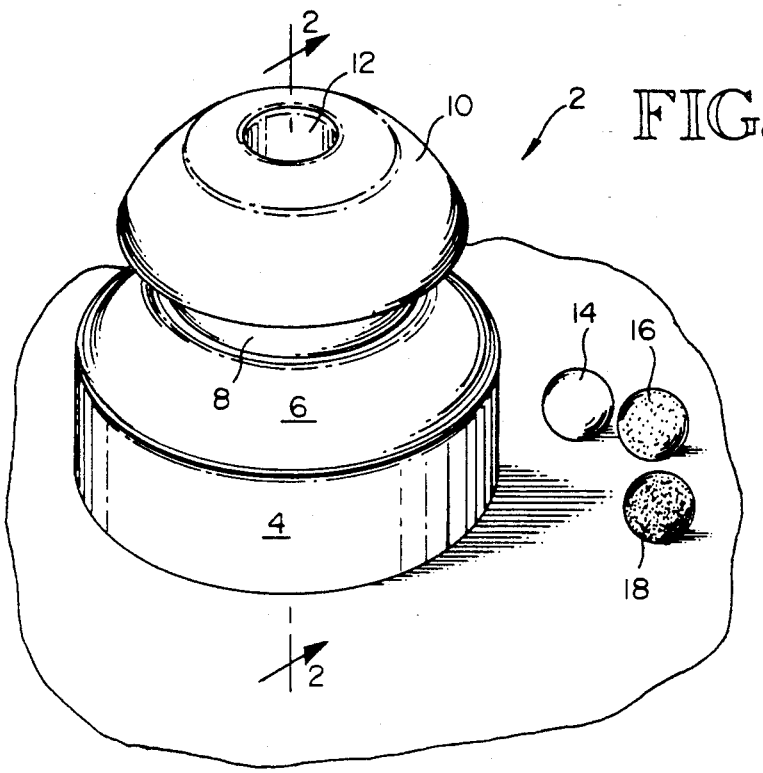
FIG. 1 is a perspective view of the exterior of the game playing apparatus and a plurality of playing pieces.

As seen in FIG. 1, the apparatus when in play includes a playing apparatus generally designated as 2, which includes a cylindrical bottom portion 4, an inwardly curved shoulder 6, a neck portion 8 and an outwardly flared, downwardly curved top 10 and a central bore 12, in addition to a plurality of playing pieces 14, 16, 18. It is to be noted that the playing pieces 14–18 are stippled to indicate a distinguishing color, but it is to be noted that each player would have a set of identical playing pieces.

Figure 2:
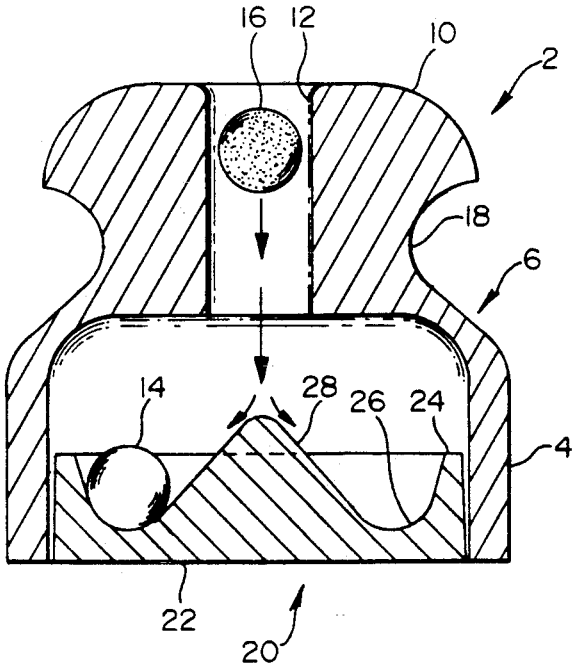
FIG. 2 is a vertical section along lines 2—2 of FIG. 1.

Reference is now had to FIG. 2, and it can be seen that the exterior playing apparatus 2 has a hollow main portion which in play captures a playing piece receiving apparatus generally designated as 20. The playing piece apparatus includes a flat base 22, has a cylindrical configuration to complement the interior cylindrical open portion of element 2, and includes an upwardly extending, circumferential edge portion 24 surrounding a trough portion 26 and an upwardly extending conical center portion 28. As seen, playing pieces drop through the opening 12, contact the upper portion of the conical element 28 and are forced into the trough 26, where they cannot be seen.

Figure 3:
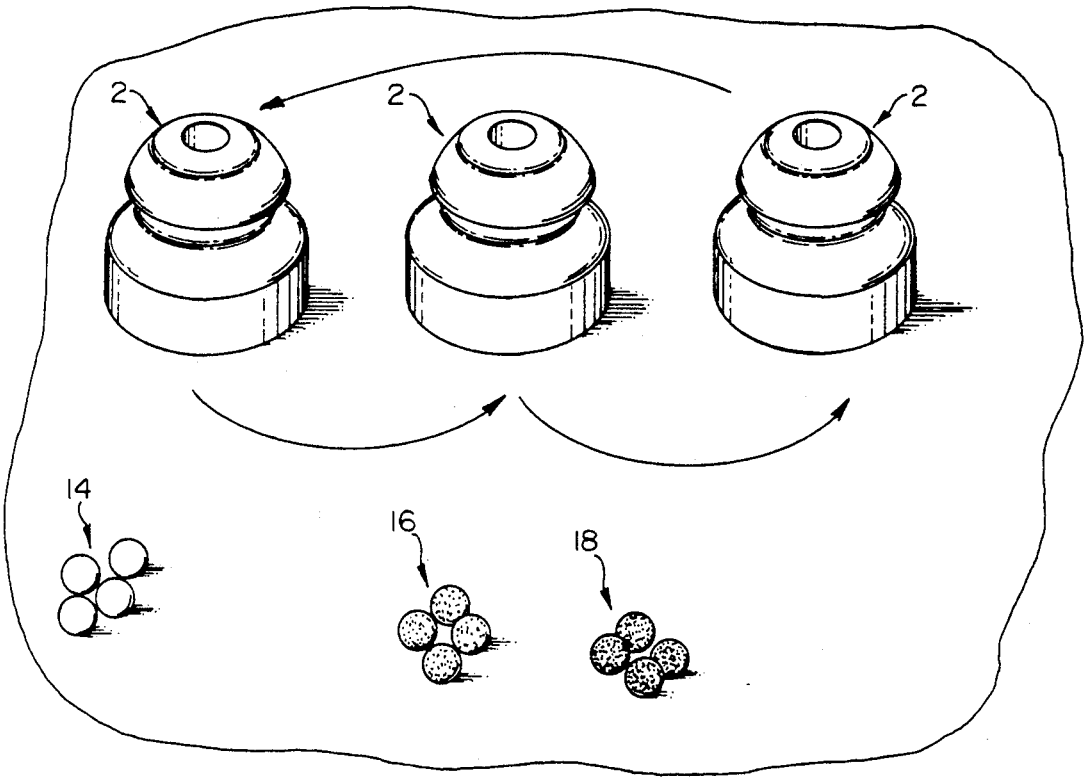
FIG. 3 is a pictorial representation showing three identical playing apparatuses along with sets of playing pieces which are distinguishable as by color.

Reference is now had to FIG. 3, where three of the play apparatuses are shown such as would be used in a game, each having a cover member generally designated as 2, it being understood that each cover member 2 would capture a playing piece receiving member 20 and each playing piece receiving member would be identified in some manner such that each set of playing pieces 14, 16, 18 would identify with the appropriate captured bottom member 20 when the game is played, as explained hereinabove.

Since, as the game is used the covers may become scarred, a provision is made that periodically the apparatuses are covered by a cloth and the cover members are switched.

Thus as can be seen, the present invention provides a relatively simple but unique game apparatus to provide entertainment and a challenge.

I claim:

1. Game apparatus for a game of memory, comprising:

a plurality of playing pieces;

a playing piece receiving means comprising a substantially cylindrical element including a flat bottom, an upwardly extending ridge extending around the circumference, and a conical center portion defining an annular trough; and a cover means including a downwardly open hollow space of a dimension to fit over the playing piece receiving means, an upwardly extending handle means, and a central vertical bore whereby playing pieces dropped through the bore strike the outer portion of the playing piece receiving means and are deflected into the trough where they cannot be seen.

2. A game utilizing the apparatus of claim 1, wherein at least three units are utilized including three sets of playing pieces wherein the pieces of each set are distinguishable from the other sets.

* * * * *